US006144271A

United States Patent [19]

Mueller et al.

[11] Patent Number: 6,144,271

[45] Date of Patent: Nov. 7, 2000

[54] CIRCUIT BREAKER WITH EASILY INSTALLED REMOVABLE TRIP UNIT

[75] Inventors: Robert W. Mueller, Aliquippa; David A. Parks, Baden; Thomas A. Whitaker, North Huntingdon, all of Pa.

[73] Assignee: Eaton Corporation, Cleveland, Ohio

[21] Appl. No.: 09/377,001

[22] Filed: Aug. 18, 1999

[51] Int. Cl.[7] ..... H01H 9/02; H01H 13/04

[52] U.S. Cl. ..... 335/202; 335/172; 335/167

[58] Field of Search ..... 335/6, 20–23, 335/25, 35, 38, 40, 41, 42, 43, 167–176, 202

[56] References Cited

U.S. PATENT DOCUMENTS 3,264,435 8/1966 Klein et al. ..... 335/35
4,146,855 3/1979 Schultz et al. ..... 335/8
5,910,760 6/1999 Malingowski .

*Primary Examiner*—Lincoln Donovan
*Assistant Examiner*—Tuyẽn T. Nguyễn
*Attorney, Agent, or Firm*—Martin J. Moran

[57] ABSTRACT

This concerns a molded case circuit breaker having separable main contacts and an operating mechanism utilized to cause the separable main contacts to open and close. A trip unit is provided to actuate the operating mechanism in desirable circumstances. The trip unit is removable. In this case the trip unit is insertable into a trip unit region in the case of the circuit breaker from the top or end thereof. The trip unit is then joined to an internal electrical conductor by way of a bolt and an internally fixed nut. The bolt can be driven into the nut through the trip unit conductor and the internal conductor from a position external to the circuit breaker case. The trip unit can be inserted into the trip unit conductor from a point above the circuit breaker case or vise versa. The trip unit has a securement nut built into its case.

8 Claims, 8 Drawing Sheets

CIRCUIT BREAKER WITH EASILY INSTALLED REMOVABLE TRIP UNIT

The subject matter of this invention is related to concurrenty filed, co-pending applications: U.S. patent application Ser. No. 09/377,001 filed Aug. 18, 1999, entitled "Circuit Breaker With Easily Installed Removable Trip Unit"; U.S. patent application Ser. No. 09/376,897, filed Aug. 18, 1999, entitled "Circuit Breaker With Lockable Trip Unit Adjustable Cover"; U.S. patent application Ser. No. 09/376,920, filed Aug. 18 1999, entitled "Circuit Breaker With Combined Slot Motor, Reverse Loop And Terminal Strap"; U.S. patent application Ser. No. 09/376,248, filed Aug. 18, 1999, entitled "Circuit Breaker With Combination Push-To-Trip And Secondary Cover Latch"; U.S. patent application Ser. No. 09/376,265, filed Aug. 18, 1999, entitled "Multi-Pole Circuit Breaker With Multiple Trip Bars"; U.S. patent application Ser. No. 09/376,816, filed Aug. 18, 1999, entitled "Circuit Breaker With Trip Unit Mounted Tripping Plunger And Latch Therefore"; U.S. patent application Ser. No. 09/377,018, filed Aug. 18, 1999, entitled "Circuit Breaker With Non-Symmetrical Terminal Collar"; U.S. patent application Ser. No. 09/376,815, filed Aug. 18, 1999, entitled "Circuit Breaker With Side Wall Opening For A Separate Auxiliary Device Actuation Lever"; and U.S. patent application Ser. No. 09/376,254, filed Aug. 18, 1999, entitled "Circuit Breaker With Dial Indicator For Magnetic Trip Level Adjustment".

BACKGROUND OF THE INVENTION

1. Field of the Invention

The subject matter of this invention is related generally to molded case circuit breakers and more specifically to removable trip units for molded case circuit breakers.

2. Description of the Prior Art

Molded case circuit breakers are well known in the art as exemplified by U.S. Pat. No. 5,910,760 issued Jun. 8, 1999 to Malingowski et al., entitled "Circuit Breaker with Double Rate Spring" and assigned to the assignee of the present application. The foregoing is incorporated herein by reference.

Molded case circuit breakers include a set of separable main contacts, one of which is usually fixed and one of which is movable for automatically opening upon the occurrence of an overload or short circuit electrical current in the network which the circuit breaker is provide to protect. The separable main contacts are opened as a result of the functioning of a latched operating mechanism, which is interconnectable by way of an operating handle to a region outside of the circuit breaker. The operating handle may be used to trip the circuit breaker manually or to reset and close the circuit breaker contacts once they have been opened automatically. The reset action is required because circuit breakers must be mechanically charged to be in a state to reopen immediately upon closure in the event that the fault which cause the tripping in the first place has not disappeared. The reset action charges the circuit breaker for that purpose. Molded case circuit breakers have trip units, which are often removably insertable in the circuit breaker case. The trip unit in addition has at least two calibratable functions, one of which is generally identified as thermal tripping and the other of which is generally identified as magnetic tripping. The trip unit includes a rotatable trip bar, which when rotated will actuate a latchable tripping operation within the operating mechanism to automatically open the circuit breaker contacts. The rotatable trip bar is usually actuated in one of two ways. The first way is in response to what is called a magnetic tripping of the circuit breaker. This occurs when the amount of current flowing through the separable main contacts of the circuit breaker is so high as to represent a potential catastrophic failure and which therefore requires exceedingly quick opening action of the circuit breaker. In such a case a electro-magnetic core, which produces magnetic flux in proportion to the amount of electrical current flowing through the separable main contacts attracts a movable armature, the movement of which eventually causes the trip bar to move to thus cause the tripping action. The second tripping occurrence is in response to a relatively low amount of overload current, which eventually will cause overheating of the electrical wires in the circuit to be protected, but which does not necessitate the instantaneous action a short circuit requires and thus does not require the magnetic action spoken of previously. In this case a bi-metal element is heated by a heater element which conducts the electrical current flowing through the separable main contacts. As the bi-metal element flexes or moves it impinges upon the tripping bar causing it to flex and move correspondingly, until eventually a point is reached in which the tripping bar causes the circuit breaker to unlatch and trip automatically. Both the magnetic trip mechanism and the thermal trip mechanism usually require initial calibration.

In one half of an AC cycle, the electrical current flows through the circuit interrupter from the load by way of a terminal collar to the load terminal of the circuit breaker and from there into the trip unit where it flows through the previously mentioned heater which in turn is serially connected to the electro-magnetic member of the magnetic trip device. From there it is interconnected by way of a flexible cable to one end of a moveable contact arm and from there to the main contact on the moveable contact arm. When the contact arm is closed, it is closed upon a fixed contact which is supported usually on unshaped conductor, which in turn is interconnected with a line terminal and there to the line terminal collar and finally to the electrical line. In addition the circuit breaker usually has an arc chute for assisting in diminishing the electrical arc drawn between the separating contacts during the opening operation for extinguishing of the arc. The circuit breaker also has a slot motor arrangement, which is utilized to interact magnetically with the electrical current flowing in the opening contact arm to accelerate the opening of the contact arm magnetically. The operating mechanism usually consists of a series of levers and linkages, which are interconnected with the separable main moveable contact arm, the handle mechanism, and by way of a latch arrangement with the aforementioned trip bar. Description and operation of all of the above may be found in the previous mentioned, incorporated by reference '760 patent.

As was mentioned, each circuit breaker usually contains a trip unit which is integrated into the circuit breaker case during the construction process and which causes the tripping of a circuit breaker due to either a magnetic level current overload or a thermal level current overload. An example of such a trip unit may be found in the aforementioned U.S. Pat. No. 5,901,760. Utilization of a trip unit of this kind usually requires mounting of the trip unit from the front or faceplate side thereof. That requires that the area above the mounting screws for the circuit breaker be left open to allow access for a driver which often results in wasted space in the circuit breaker. It would be advantageous if a trip unit could be found in which this wasted space is no longer required and which could be placed into the circuit breaker very late in the manufacturing process, even after the main circuit breaker frame had been completed.

SUMMARY OF THE INVENTION

In accordance with the invention there is circuit interrupter device having a housing. There is an operating mechanism means disposed within the housing. Also separable contacts are disposed within the housing in cooperation with the operating mechanism for being opened by the operating mechanism, a trip unit is disposed within the housing in cooperation with the operating mechanism for actuating the operating mechanism for opening the separable contacts, the trip unit has an internal trip unit conductor with an external terminal, the external terminal is connectable in a region outside of the housing with an external conductor, a frame conductor is disposed electrically between the separable contacts and the internal trip unit conductor, there is also a bolt for joining the internal trip unit conductor and the frame conductor, the bolt is accessible from said region outside of the housing.

BRIEF DESCRIPTION OF THE DRAWINGS

In accordance with the invention, reference may be had to the preferred embodiment thereof, shown in the accompanying drawings in which.

DESCRIPTION OF THE PREFERRED EMBODIMENT

Figure 1:
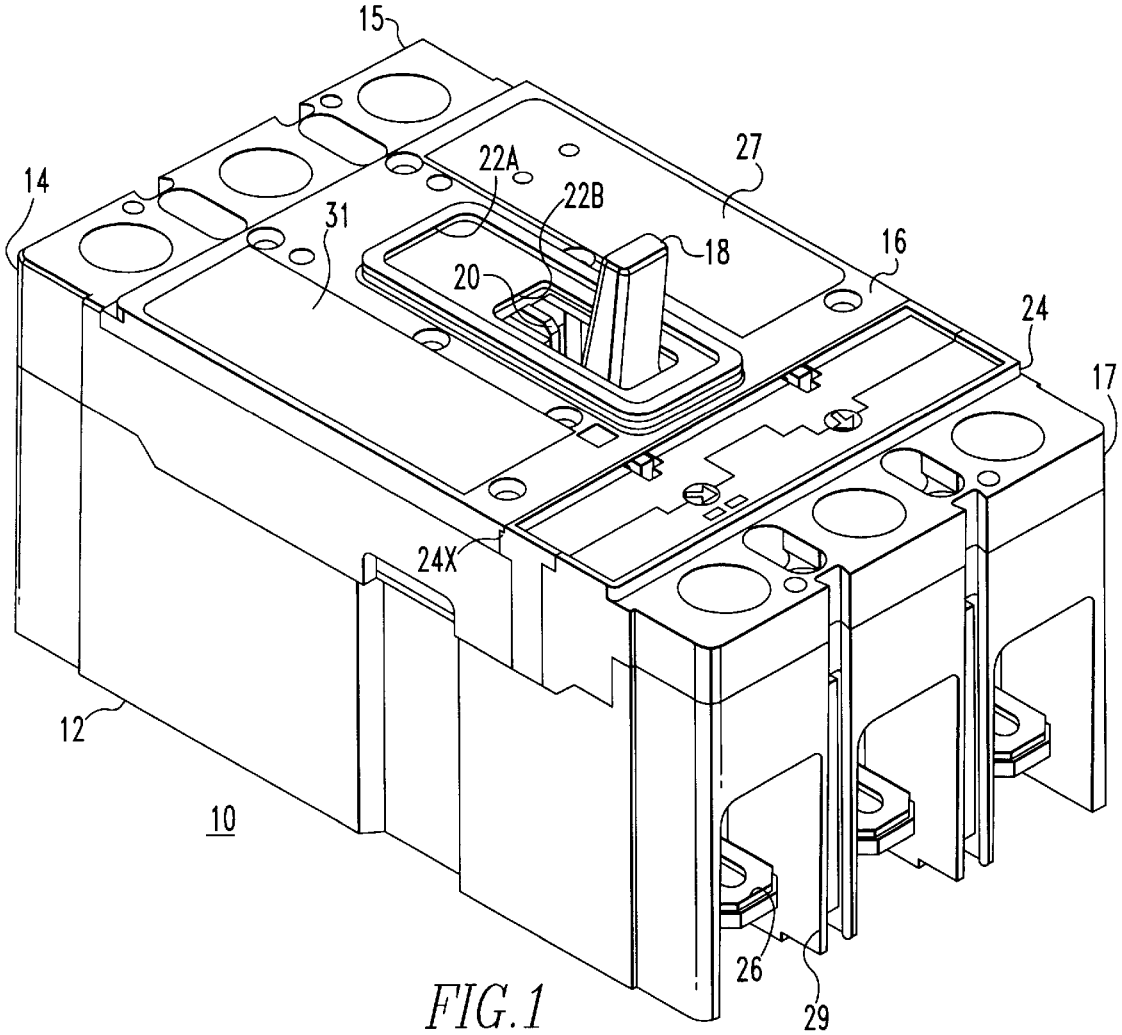
FIG. 1 is an orthogonal view of a three-phase molded case circuit breaker employing embodiments of the present invention.

Referring now to the drawings and FIGS. 1 through 4 in particular, there is shown a molded case circuit breaker or interrupter 10 having a main base 12 and primary cover 14. Attached to the primary cover 14 is a secondary cover 16. A handle 18 extends through a secondary escutcheon 22A in the secondary cover 16 and aligned primary escutcheon 22B in the primary cover 14. An operating mechanism 20 is interconnected with the handle 18 for opening and closing separable main contacts in a manner which will be described hereinafter. This circuit breaker has a line end 15 and load end 17. The circuit breaker or interrupter includes a removable trip unit 24. Removable trip unit 24 has an underlapping lip 24X, the purpose of which will be described hereinafter. There are also depicted a load terminal 26, a right side accessory region or pocket 27 and a left side accessory pocket or region 31.

Figure 2:
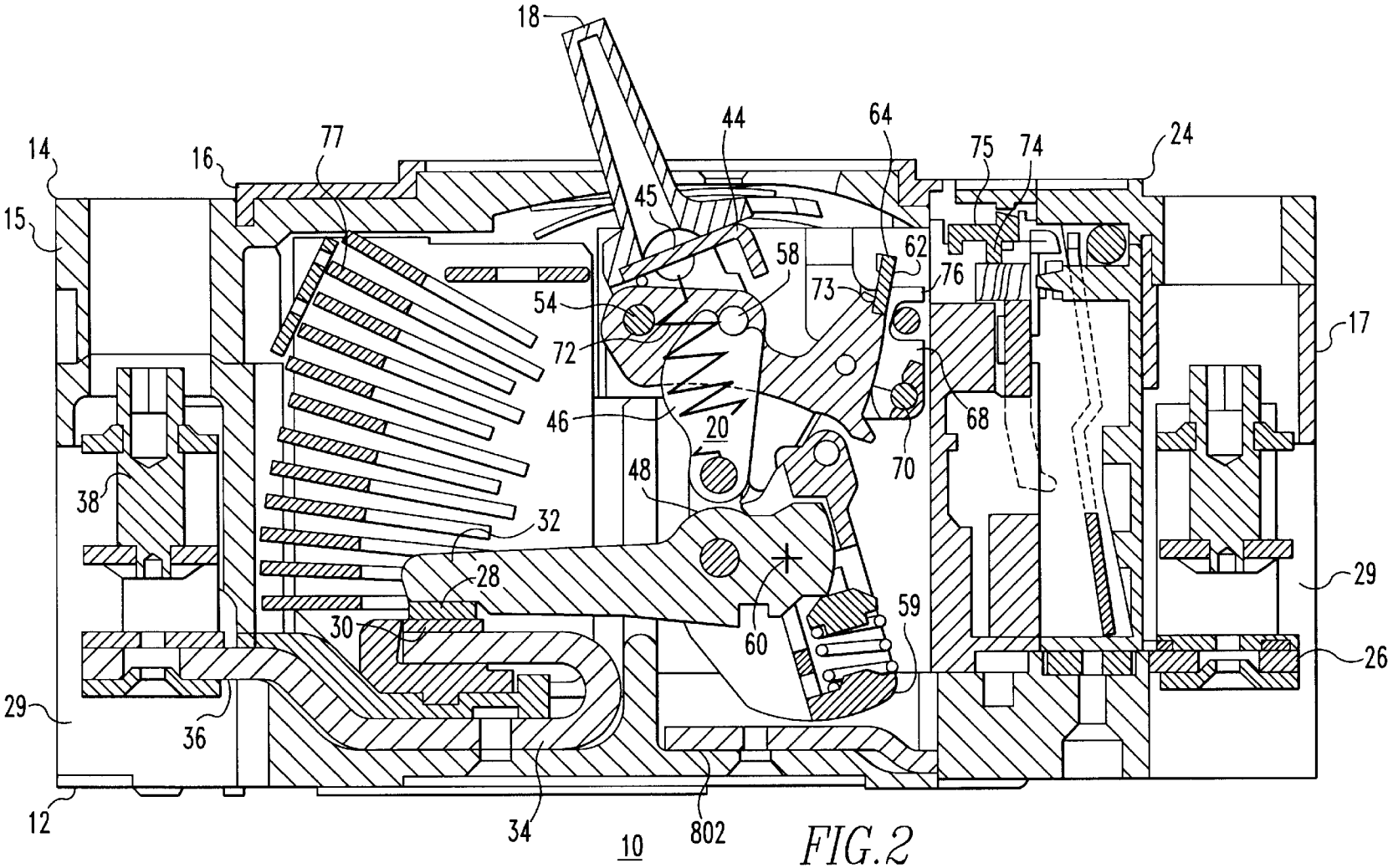
FIG. 2 is a cut away side elevation section of the circuit breaker of FIG. 1, depicting the circuit interrupter in the closed state.
Figure 3:
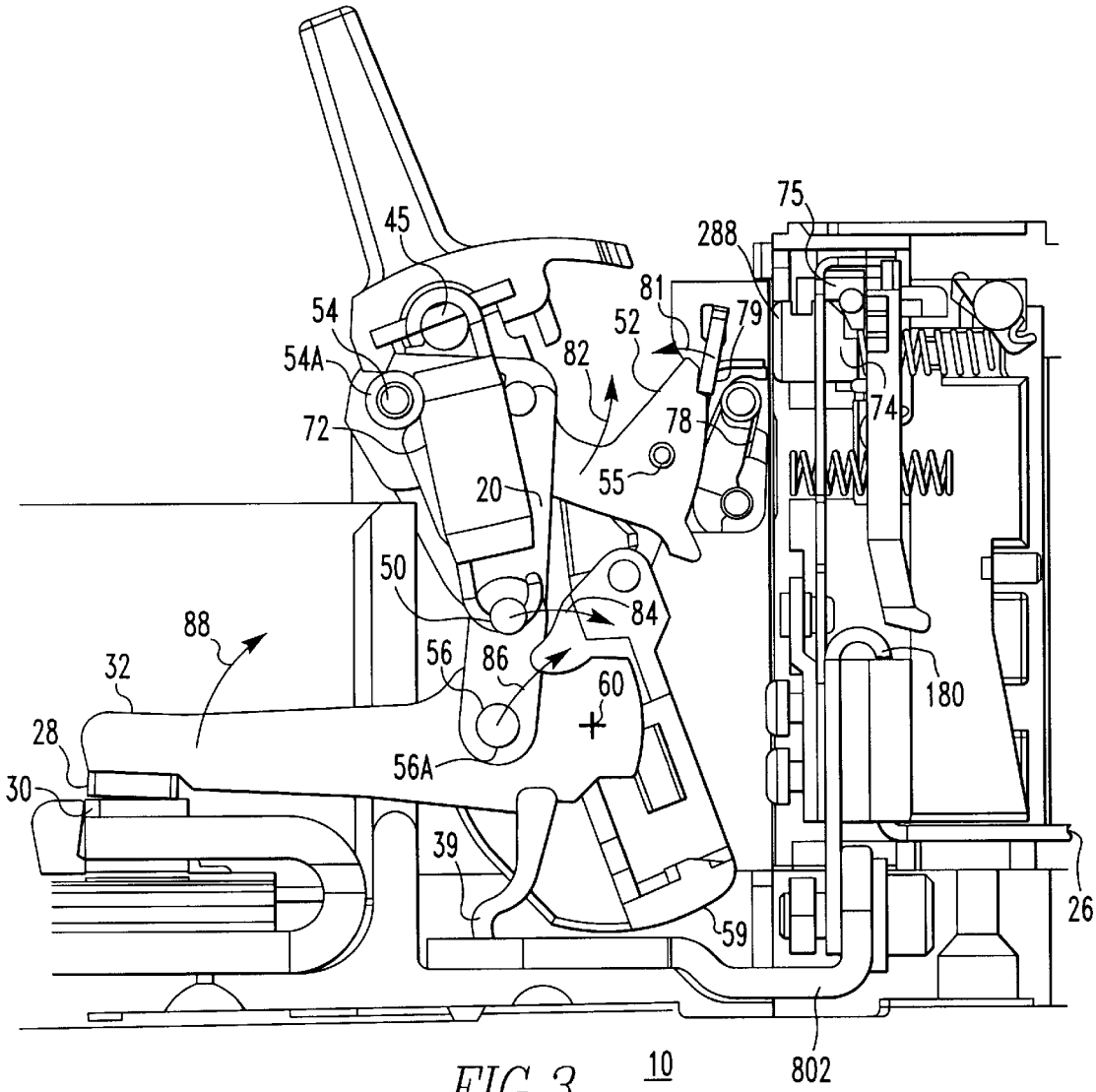
FIG. 3 is a side elevation view similar to that shown in FIG. 2, concentrating on the circuit breaker operating mechanism and trip unit.
Figure 4:
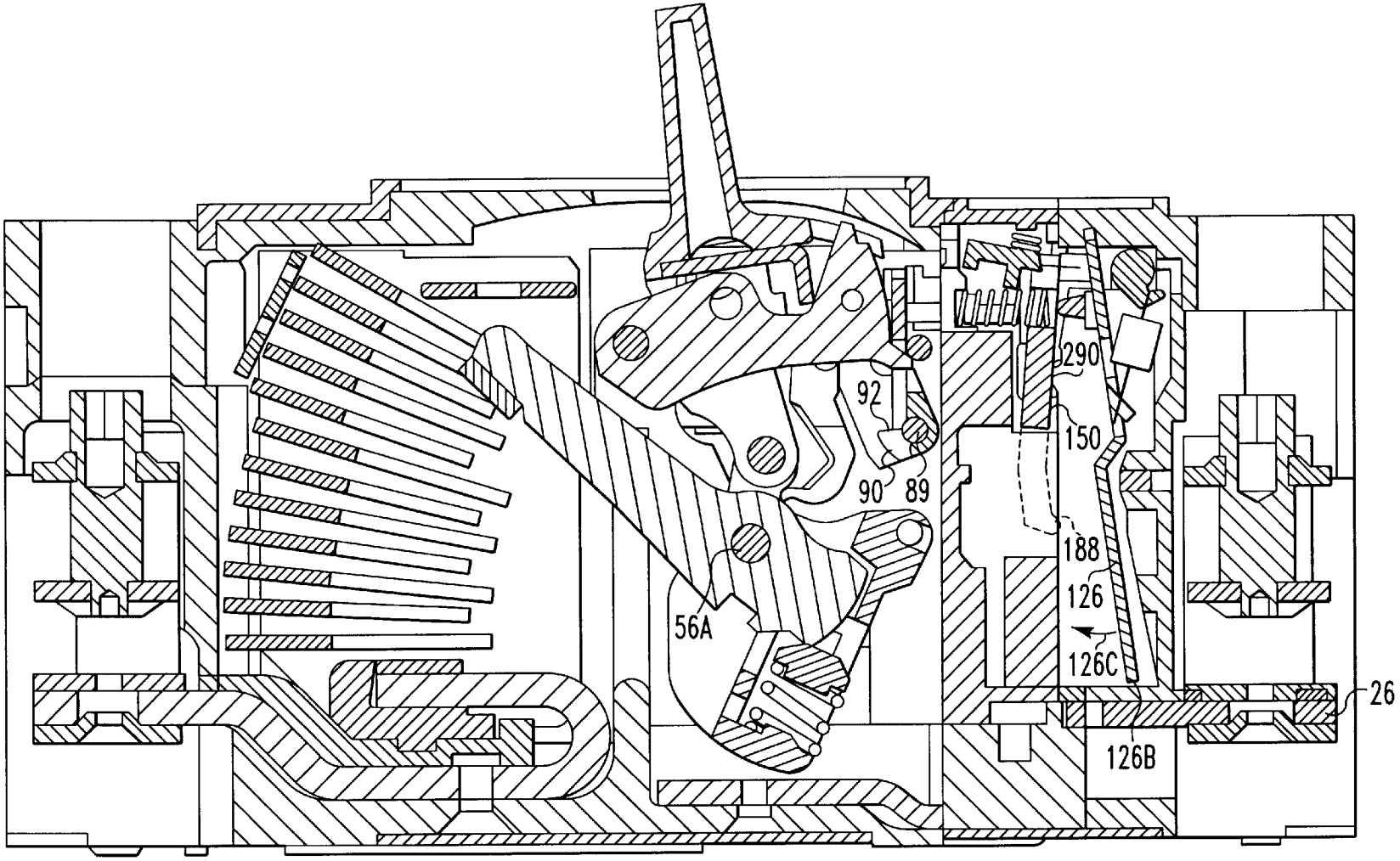
FIG. 4 is similar to FIG. 2, but depicts the circuit interrupter in the tripped state.
Figure 5:
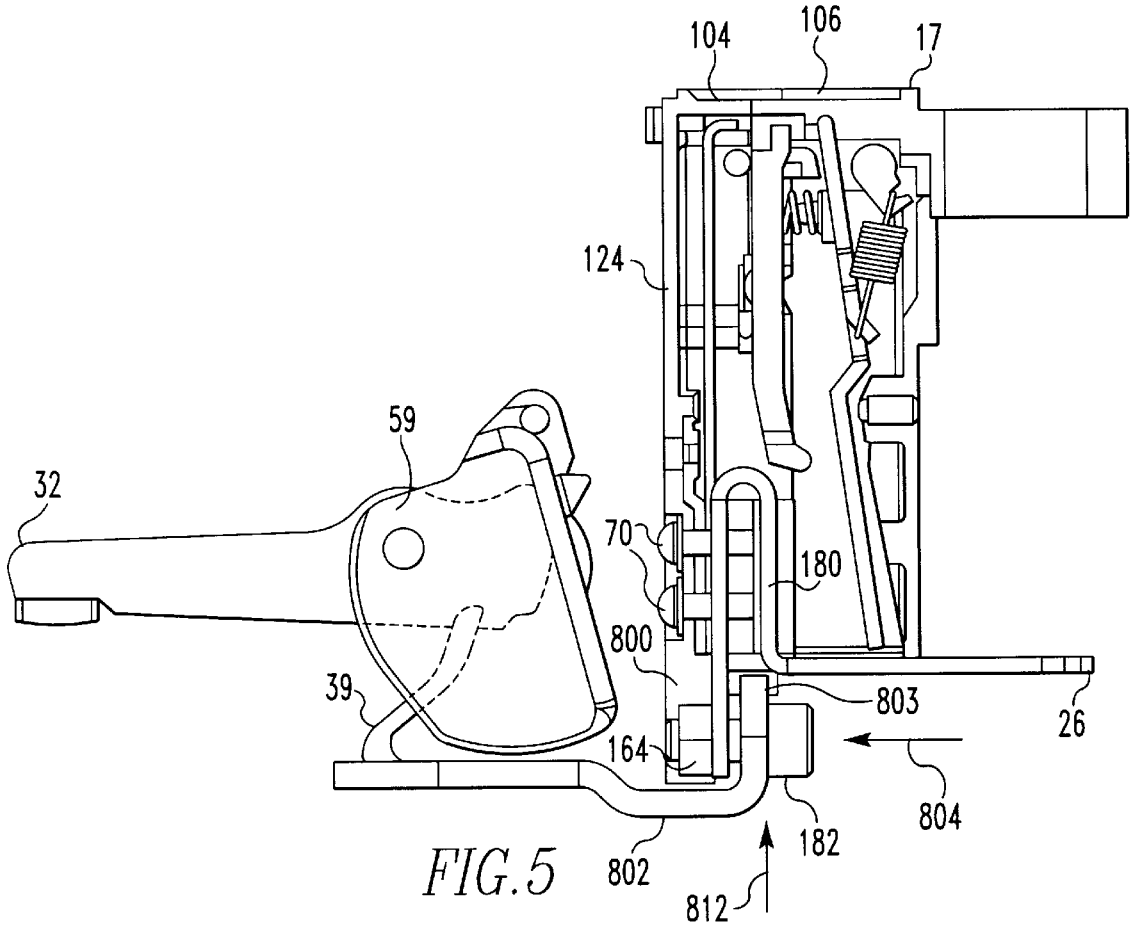
FIG. 5 depicts a portion of the trip unit of FIGS. 1 through 4, broken away and in section depicting the interconnection of the load terminal with the internal conductors of the circuit interrupter.
Figure 6:
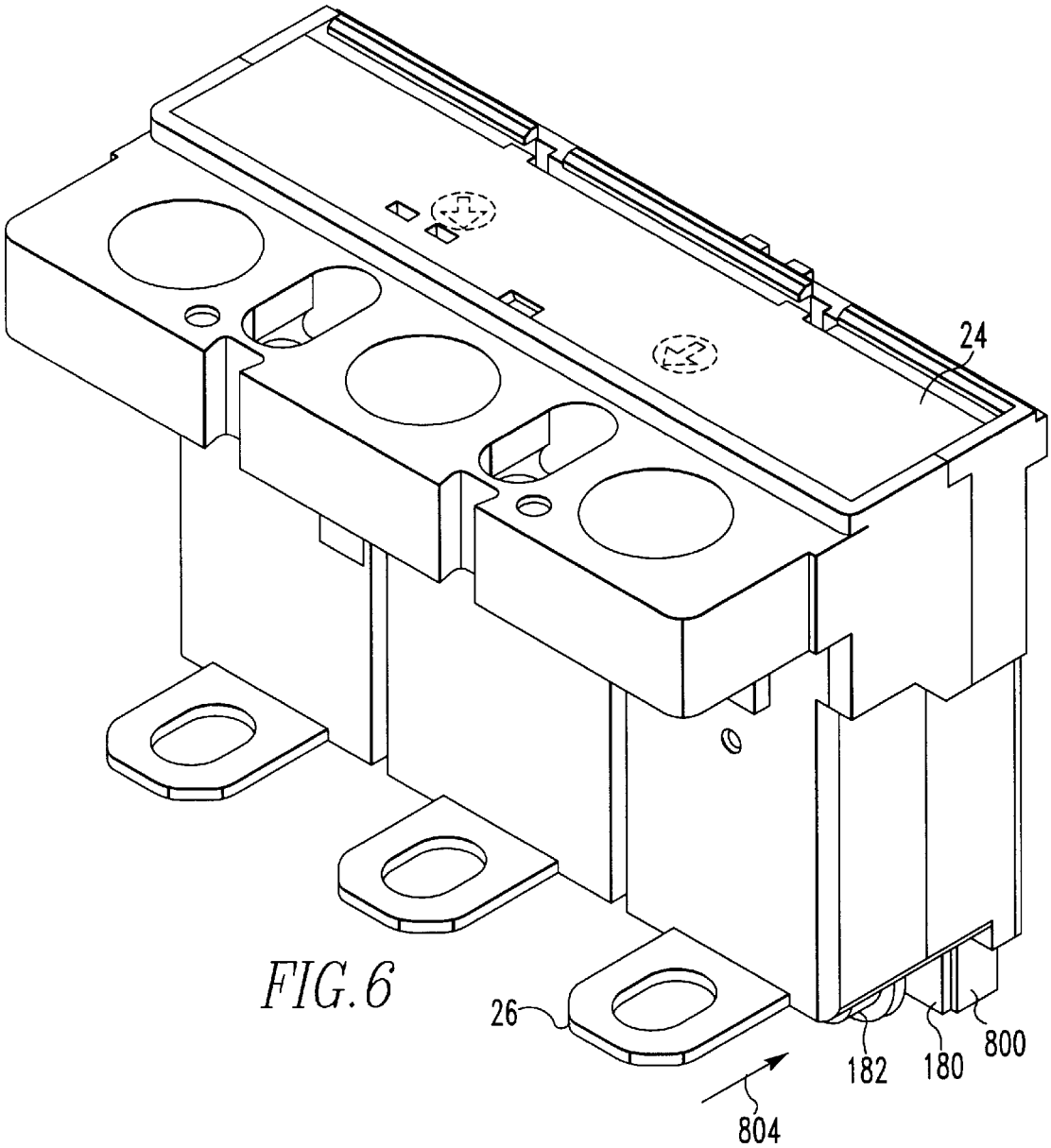
FIG. 6 shows an orthogonal view of the removable trip unit of FIGS. 1 through 4.

Referring now more specifically to FIGS. 2, 3 and 4, there are depicted a separable movable contact 28 disposed upon a moveable contact arm 32 and a fixed contact 30 disposed upon a fixed contact support or unshaped member 34. Line terminal 36 is disposed to the left in FIG. 2, for example, at the line end 15 of the circuit interrupter in a terminal cave or pocket 29. A load terminal 26 is disposed to the right in FIG. 2, for example, in a load terminal cave or pocket 29. To the left on the line terminal 36 is disposed a line terminal collar 38 which will be described in more detail hereinafter, and to the right is provided a load terminal jumper-to-movable contact arm conductor 802. Connected to conductor 802 is a flexible conductor 39, which is interconnected with movable contact arm 32 as shown schematically. The load terminal jumper or frame conductor 802 is interconnected at its other end with a bi-metal heater 180, which in turn is interconnected at its other end with the terminal 26. Consequently, when the circuit interrupter separable main contacts 28 and 30 are closed upon each other, there is a complete circuit through the circuit interrupter from right to left starting with line conductor 26 through bi-metal heater 180, through load terminal jumper or frame conductor 802, through flexible conductor 39, through the movable contact arm 32, through contact 28 to contact 30 and from there through the fixed contact support or unshaped member 34 to line terminal 36.

There is provided a operating mechanism 20 for assisting in opening and closing the separable main contacts 28 and 30. In particular, the operating mechanism includes a cradle 52, which is pivoted on one end at a cradle fixed pivoted pin 54 by way of an opening 54A in the cradle for placement of the cradle fixed pivoted pin therein. The cradle includes a cradle-to-side accessory region side protrusion 55. There is provided an upper toggle link 46 and a lower toggle link 48. They are joined pivotally by an upper and lower toggle link pin 50. There is provided a lower toggle link to movable contact arm main pivot assemble attachment pin 56, which is affixed to the movable contact arm 32 at an opening 56A. There is also a cradle to upper toggle link pivot pin 58, by which the upper toggle link 46 is placed in physical contact with the cradle 52. There is also provided a movable contact arm main pivot assembly 59, which movably, rotatably pivots on a pivot 60. There is also provided a primary frame latch 62 which operates or rotates on a primary frame latch pivot 64. The primary frame latch 62 cooperates with a secondary frame latch 68, which rotates on a secondary frame latch pivot 70. The operating power for the tripping operating of the circuit breaker is provided by a charged main toggle coil spring 72. The main toggle coil spring is interconnected with a handle yoke 44 by way of a handle yoke attachment post 45. The other end of the spring 72 is attached to the toggle link pin 50. Cradle 52 has a cradle lip 73, which is captured or held in place by the primary latch 62 when the separable main contacts 28 and 30 are closed. No tripping of the circuit breaker can take place by way of the operating mechanism until the aforementioned primary frame latch 62 has been actuated away from the cradle lip 73 in a manner which will be described hereinafter. There is provided a combination secondary-frame-latch-primary-frame-latch torsion spring 78, which exerts force against both latches sufficient to cause appropriate movement thereof at the appropriate time. The secondary frame latch has a laterally extending trip protrusion 79, the purpose of which will be described later hereinafter. Actuation of the primary and secondary frame latches occurs exclusively by way of the utilization of a resetable trip unit trip plunger 74, which is contained entirely within the removable trip unit 24. The trip unit trip plunger 74 is controlled or latched by way of a plunger latch or interference latch 75. The secondary frame latch 68 is in disposition to be struck by the moving trip unit plunger abutment surface 288. Upon opening of the separable main contacts 30 and 28, an electric arc is drawn therebetween which is exposed to an arc chute 77. The secondary frame latch 68 has a bottom portion 89, upon which is disposed an arcuate stop surface 90 for the primary frame latch 62. There is also provided above that arcuate stop surface and as part of the acruate stop member a latch surface 92.

The operating mechanism described herein may be the same as found in U.S. Pat. No. 5,910,760 issued Jun. 8, 1999 to Malingowski et al., entitled "Circuit Breaker with Double Rate Spring". Thought the primary and secondary frame latches are disposed within the case 12, the trip unit plunger 75 is responsible for initiating all tripping action from the trip unit 24 into the region of the secondary latch 68. Alternatively, the secondary latch 68 may be actuated by a push-to-trip button in a manner, which will be described hereinafter. The secondary latch 68 is actuated to rotate to the left as shown in FIGS. 2, 3 and 4, for example, in direction 81 about its pivot 70. As this occurs the acruate stop surface 90 for the secondary frame latch 68 rotates away from the bottom of the primary frame latch 62 until the lateral latch surface 92 rotates into a disposition to allow the bottom of the primary frame latch 62 to rotate to the right under the force of the cradle 72. This causes the primary frame latch 62 to clear the lip 73 of the cradle 52 to allow the cradle 52 to rotate upwardly about its pivot 54 in a direction 82 under the power of the now collapsing coil spring 72 by way of the force exerted thereupon by the upper toggle link 46 acting against the cradle-to-upper-toggle link connecting pin 58. As the toggle spring 72 relaxes, the upper and lower toggle links collapse, which in turn causes the lower toggle link to movable contact arm pivot assembly 56 to rotate upwardly in the direction 86 about its pivot 60. This, of course, causes the contact arm 32 to rotate similarly in the direction 88, thus opening the separable main contacts 28 and 30 and in most cases establishing an electrical arc of conducting electrical current there across. The action of the secondary frame latch 68 can be duplicated by causing secondary latch push-to-trip member side laterally extending trip protrusion 79 to rotate in the direction 81 by operation of a push-to-trip member which will be described later hereinafter. Resetting of the circuit breaker is accomplished in a matter well known in the prior art and described and shown with respect to the aforementioned U.S. Pat. No. 5,910,760. The important part of the operation with respect to this feature is the movement of the secondary frame latch point 76 in the direction opposite to direction 82, against the plunger face 288 in a manner, which will be described later hereinafter. However, if movement of the plunger face 288 in the rightward direction against its plunger spring, as will be described hereinafter, is prevented because of the latching of the plunger member 74, in a manner which will be described hereinafter, then the circuit breaker can not be reset. An important feature of the invention lies in the fact that the ultimate control of the resetting of the circuit breaker and tripping of the circuit breaker can be accomplished only from the removable trip unit 24, rather than from the operating mechanism 20.

Figure 7:
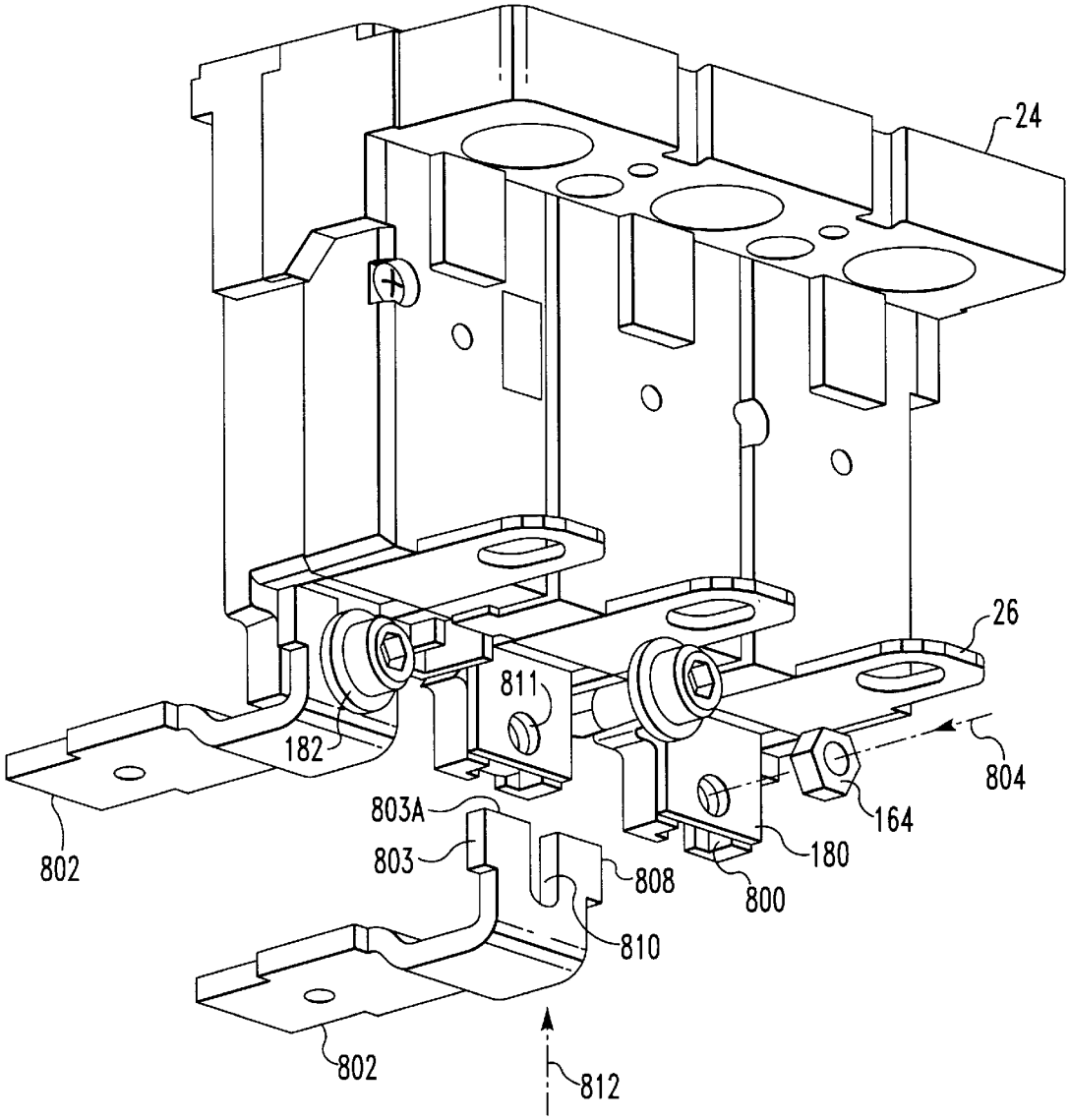
FIG. 7 shows a bottom orthogonal view of the trip unit of FIG. 6 in exploded form showing the arrangement of the interconnection of conductors.
Figure 8:
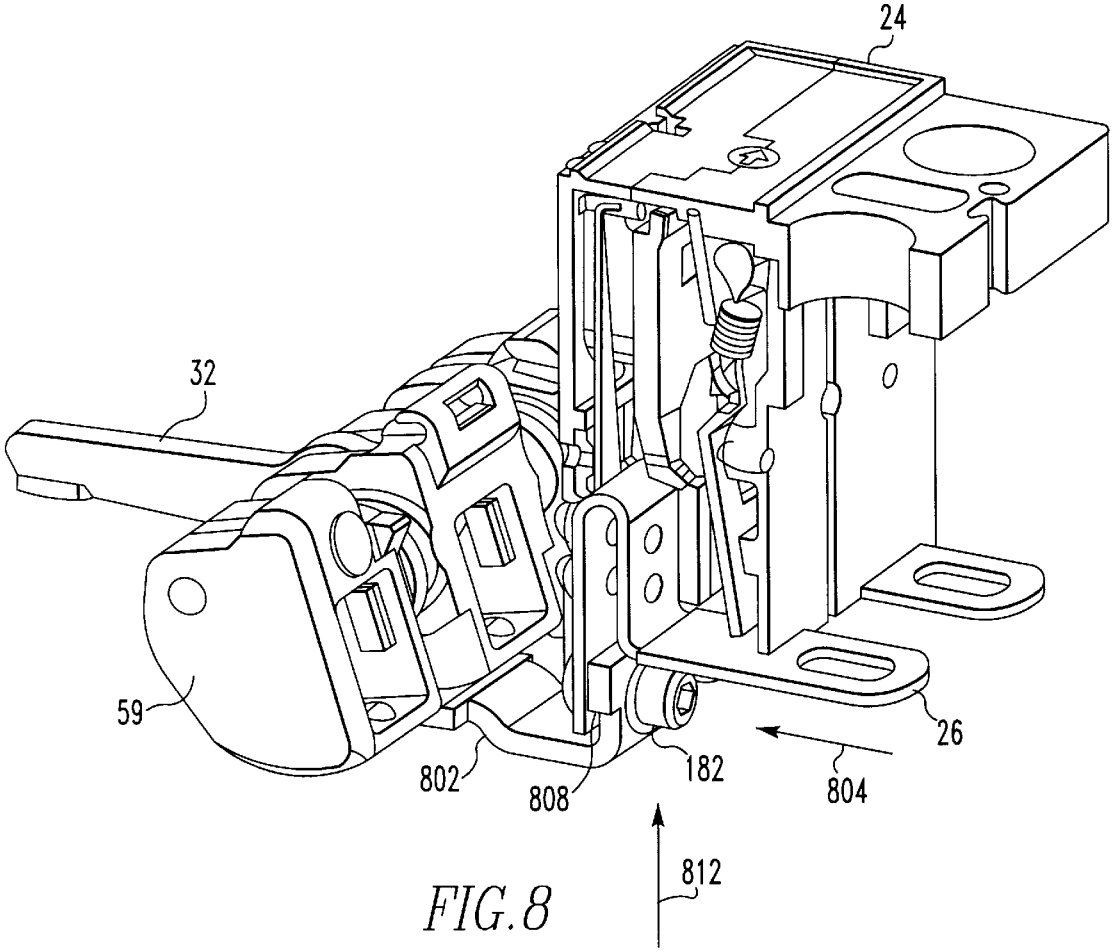
FIG. 8 shows a side orthogonal view similar to that shown in FIG. 7.

Referring now to FIGS. 5 through 8 an embodiment of the invention is shown. In this embodiment of the invention, a pre-attachment nut casing 800 is disposed in the back wall of the back portion 104 of the trip unit 24. As shown in FIG. 7, a three-pole circuit breaker 10 shows three stages of assembly for the nut casing 800, one stage on each pole. On the far right pole, an empty nut casing 800 is shown with the nut 164 shown exposed for clarity. The middle pole nut casing 800 shows the nut 164 within the nut casing 800 and a bolt 182 positioned to engage the nut 164. The left pole nut casing 800 shows member 802 positioned adjacent to nut casing 800 with bolt 182 engaging nut 164, which cannot be seen as it is hidden by member 802. There is provided a load terminal jumper or frame conductor 802, which interconnects the heater 180 with the movable contact arm 32 via a flexible conductor 39 which joins the back part of the arm 32 in the region of the rotating assembly 59. The vertical portion 803 of the load terminal jumper 802 is best seen in FIG. 7 as being bifurcated and having a pair of tines 803A which are deposed around a unshaped opening 810. Member 802 may be moved upwardly into the casing 800 to align the nut 164 with the pre-existing hole 811 in the back portion of the member 180 and with the fastening bolt 182. The fastening nut 804 may be driven in the direction 804 through the unshaped opening 810 into the pre-disposed nut 164 and hole or opening 811 in the back member of the heater 180 for complete fastening thereof. Also the ushaped opening and the tines may be inserted into the path 804 of the bolt 182 from the direction 812 to reduce manufacturing compilation even more. This eliminates the requirement for fastening the arrangement within the circuit breaker itself during the initial construction process, which is a feature of the present invention. Since the trip unit represents the entire load end of the circuit breaker such a construction process is possible, which greatly reduces manufacturing compilation and time.

What we claim as our invention is:

1. A circuit interrupter device, comprising:

a housing;

an operating mechanism means disposed within said housing;

a separable contact means disposed within said housing having two contacts which are structured to open;

said operating mechanism coupled to said separable contact means;

said operating mechanism structured to open said separable contact means;

a trip unit means disposed adjacent to said housing and coupled with said operating mechanism means for actuating said operating mechanism means for opening said separable contact means, said trip unit means having an internal trip unit conductor means with an external terminal means, said external terminal means structured to connect to an external conductor which is disposed outside of said housing;

a frame conductor means disposed electrically between said separable contact means and said internal trip unit conductor means; and a detachable joining means structured to join said internal trip unit conductor means and said frame conductor means, said joining means having a portion which is accessible from outside of said housing.

2. The combination as claimed in claim 1, wherein said joining means comprises a nut and a bolt, wherein said frame conductor means and said internal trip unit conductor means each have corresponding openings, said bolt traversing said openings, said nut being threadably engaged with said bolt for capturing said frame conductor means and said internal trip unit conductor means therebetween.

3. The combination as claimed in claim 2, wherein said internal trip unit conductor means and said frame conductor means are structured to overlap and said trip unit means is structured to slide in a first direction, wherein one of said openings is not completely enclosed and wherein one of said internal trip unit conductor means or said frame conductor means has said nut pre-attached thereto.

4. The combination as claimed in claim 3, wherein said nut is threadably engaged with said bolt from said region outside of said housing in a direction generally transverse to said first direction.

5. The combination as claimed in claim 3, wherein said frame conductor means opening is not completely enclosed by said internal trip unit conductor means.

6. The combination as claimed in claim 3, wherein said internal trip unit conductor has said nut means pre-attached thereto.

7. The combination as claimed in claim 1, wherein said trip unit means is detachable from said housing, wherein said internal trip unit conductor means and said frame conductor means are structured to overlap and said trip unit is structured to slide in said a first direction, wherein one of said openings is not completely enclosed and wherein one of said internal trip unit conductor means or said frame conductor means has said nut pre-attached thereto.

8. A circuit device, comprising:

a housing;

first circuit means disposed within said housing, said first circuit means having a conductor means with first terminal means and second terminal means;

second circuit means disposed adjacent to said housing, said second circuit means having a conductor means with first terminal means and second terminal means; and detachable joining means structured to join said first circuit means second terminal means with said second circuit means first terminal means, said joining means comprising a nut and a bolt, wherein said first circuit means second terminal means and said second circuit means first terminal means each have corresponding openings, said bolt traversing said openings, said nut being threadably engaged with said bolt for capturing said first circuit means second terminal means and said second circuit means first terminal therebetween, wherein said first circuit means second terminal means and said second circuit means first terminal means are structured to overlap and said trip unit is structured to slide said second circuit means in a first direction, wherein said one of said openings is not completely enclosed and wherein one of said first circuit means second terminal means and said second circuit means first terminal means has said nut pre-attached thereto, said joining means being accessible from outside of said housing in a direction generally perpendicular to said first direction.

* * * * *